United States Patent [19]

Dugan

[11] 3,972,366

[45] Aug. 3, 1976

[54] METHOD OF AND APPARATUS FOR MAKING COMPOUND ROLLS

[75] Inventor: John M. Dugan, Pittsburgh, Pa.

[73] Assignee: Blaw-Knox Foundry & Mill Machinery, Inc., Pittsburgh, Pa.

[22] Filed: Nov. 29, 1974

[21] Appl. No.: 528,408

[52] U.S. Cl. ..... 164/52; 164/95; 164/252; 164/332

[51] Int. Cl.[2] ..... B22D 27/02

[58] Field of Search ..... 164/52, 252, 98, 99, 164/106, 107, 348, 332, 100, 101, 102, 103, 104, 105, 94, 95

[56] References Cited

UNITED STATES PATENTS

| | | | |
|---|---|---|---|
| 1,132,611 | 3/1915 | Osler | 164/112 X |
| 3,603,374 | 9/1971 | Cooper | 164/52 |
| 3,670,800 | 6/1972 | DeVos | 164/102 X |

FOREIGN PATENTS OR APPLICATIONS

| | | | |
|---|---|---|---|
| 2,003,607 | 8/1971 | Germany | 164/52 |

OTHER PUBLICATIONS

Dugan, John M., "Roll Specifications For Finishing Stands of a Modern Continuous Hot Strip Mill", Mar., 1970.

*Primary Examiner*—Ronald J. Shore
*Attorney, Agent, or Firm*—Smith, Harding, Earley & Follmer

[57] ABSTRACT

A method of making a compound roll of the type having a shell portion of a material that has a high hardness and wear resistance and a core portion forming the center core and neck sections of a material that has a low alloy content and a relatively low hardness so as to be highly resistant to breakage, which method comprises the steps of precasting the shell portion in the form of a hollow cylinder having the desired external and thickness dimensions, setting the shell portion on top of a neck forming mold section with the longitudinal axes of the shell portion and the mold section extending vertically, positioning an electrode of an electro-slag melting unit within the interior of the shell portion and the neck mold section, the electrode being made of material which in the remelted and subsequent resolidified condition will have the desired properties for the center core and neck sections, and passing electric current through the electrode to cause melting thereof to progressively fill the mold section and the interior of said shell portion.

10 Claims, 3 Drawing Figures

METHOD OF AND APPARATUS FOR MAKING COMPOUND ROLLS

BACKGROUND OF THE INVENTION

Rolling mill rolls are often made of what is known in the art as a "compound roll". These compound rolls have been made by various manufacturing processes such that the roll in its finished condition has a shell providing the working surface area made of a high alloy material having high hardness and wear resistance and a portion forming the center core and neck sections made of a material with low alloy content and low hardness compared with the shell material. The purpose of producing such a compound roll is to provide a roll which has a high hardness wearing surface while at the same time has neck and center core portions that are resistant to breakage.

It is to be understood that the term "compound roll" as used in this description is considered to refer to all types of rolls which have the above-described dual qualities. In the art, such rolls are referred to by various terms in addition to "compound rolls", such as duplex rolls, double-poured rolls, and differentially heat-treated rolls, as well as other terms.

The most common method of producing compound rolls is by the double-pouring method, which method is also called the dilution, replacement or run-off method. In accordance with this method, a roll mold, which is set to extend along a vertical longitudinal axis, is filled with a high alloy, high hardness metal up to a run-off gate location. After waiting a sufficient length of time to permit solidification of a proper amount of shell thickness, a low alloy, low hardness molten metal is introduced into the mold. Sufficient metal is used to either dilute or replace the necks and center of the roll casting and to fill a shrinkhead portion of the mold above the mold portion forming the upper neck. The shrinkhead portion is filled with the same metal as is used in the dilution process and provides feed metal as the molten casting solidifies and shrinks. After completion of the solidification process, the shrinkhead portion containing a large central void is removed from the casting proper and the result is a compound roll with the proper combination of core and neck breakage resistant qualities in conjunction with the high hardness qualities desired for the wearing surface area.

Another method for making compound rolls is a variation of the above-described method and involves pouring the high hardness shell metal in the same manner as described above and then, after waiting a predetermined amount of time to permit the shell material to solidify, the remaining center portion of the molten metal is drained out and replaced with the low alloy, low hardness material by simply pouring the second metal into the top end of the drained out shell.

Other methods for making compound rolls involve the use of special heat treating processes to provide microstructural differences in the two areas of the roll so that the wanted mechanical properties are produced.

Another method in use today for producing compound rolls involves centrifugal casting.

All of the above-described prior art methods for making compound rolls have several significant disadvantages. The methods involving static casting, namely, dilution, run-off, replacement, etc., require the melting of very substantial amounts of excess metal, and all of these processes, by their very nature, require very precise control in order to produce a satisfactory compound roll. Moreover, for the class of compound rolls using a shell material having a high chromium content (13% or more), excessive amounts of flow through material must be provided. Excessive amounts of flow-through material must be provided in order to decrease the chromium content of the metal which will eventually form the center core and neck portions. Many roll makers aim to reduce the center core material to 1% maximum chromium. This requires more than 180% dilution material. This makes the replacement method very costly.

The centrifugal casting process also requires very precise control in order to achieve satisfactory results and involves the use of equipment that is expensive to obtain and to maintain.

The making of compound rolls by complex differential heat treating methods is very expensive because of the use of special heat treating equipment.

SUMMARY OF THE INVENTION

It is the general object of the invention to provide a new and improved method of making compound rolls.

Briefly stated, the method in accordance with the invention comprises the steps of pre-casting to the desired dimension the shell portion of the compound roll out of material that has high hardness and wear resistance. The pre-cast shell is then set in a vertical position between upper and lower mold sections which form the neck portions of the compound roll. An electrode of an electro-slag melting unit is introduced within the shell portion and the mold sections, such electrode having been pre-cast to the desired size and out of the material having the desired chemical composition to produce the center core and neck portion of the compound roll. Using standard electro-slag melting techniques, the electrode is melted to thereby fill in sequence in a continuous process, the bottom neck portion mold section, the center part of the pre-cast shell which, in effect, forms the central part of the roll mold, and finally the top neck portion mold section. As the shell portion is filled with the electro-slag melted electrode material, there is an intimate bonding of the two materials.

By utilizing well known electro-slag melting methods the composition of the center core and neck portion can be controlled within very precise limits. Moreover, the bonding between the center core and pre-cast shell portions of the roll can also be controlled precisely.

An important advantage of the method in accordance with the invention is that it provides a most economical means for producing compound rolls. Moreover, the required qualities of the various parts of the compound roll can be controlled precisely. Also, the method in accordance with the invention is not subject to the many variations in result which are possible in the dilution, draining-off, and centrifugal castng processes. Furthermore, the method in accordance with the invention is much more economical than the prior art methods because it does not require large amounts of run-off material.

DESCRIPTION OF THE PREFERRED EMBODIMENT

Figure 1:
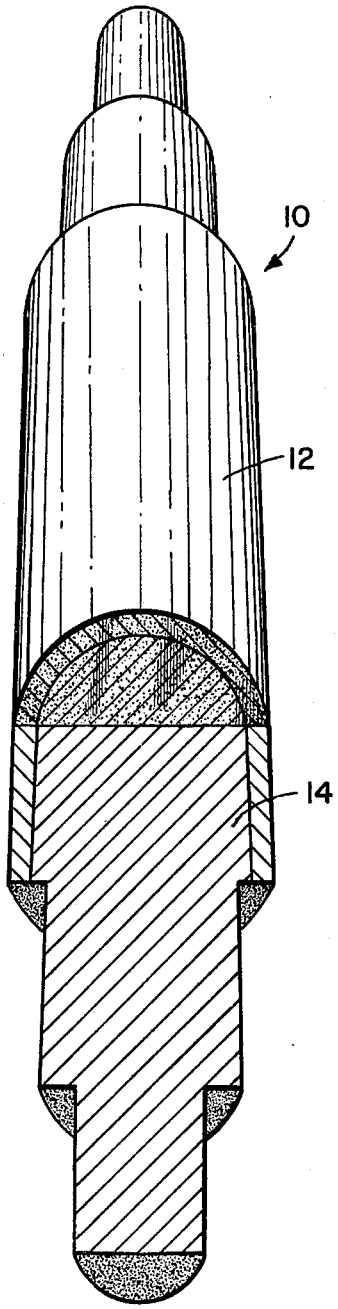
FIG. 1 is a view of a compound roll.

In FIG. 1 there is shown a compound roll 10 of the type to which the invention pertains. The compound roll 10 comprises a shell portion 12 of a wear resistant material and a core portion 14 forming the roll center core and neck sections of a material highly resistant to breakage (i.e., one having a low alloy content and low hardness). The composition of a typical material for the shell portion 12 having the desired high hardness and wear resistant properties is as follows:

% C = 2.55 – 2.65
% Mn = 1.05 – 1.15
% Si = 0.40 – 0.50
% Ni = 0.75 – 1.25
% Cr = 12.50 – 13.50
% Mo = 0.50 – 0.60

This material typically will have a heat-treated hardness of 65–67 on the Shore Scleroscope C scale.

The composition of a typical material for the core portion 14 having the desired high breakage resistance is as follows:

% C = 3.00 – 3.10
% Mn = 0.45 – 0.55
% Si = 1.00 – 1.10
% Ni = 0.70 – 0.80
% Cr = 0.95 – 1.05
% Mo = 0.10 – 0.20

This material typically will have a hardness of approximately 38 on the Shore Scleroscope C scale.

It is to be understood that the above materials are illustrative and that various materials well known in the art for making compound rolls may be used. For making compound rolls, various other wear-resisting materials, notably the class of steel compositions referred to under the general classification of "tool steels", may be used.

In accordance with the method of the invention, the shell portion 12 is pre-cast in the form of a hollow cylinder to the desired dimensions of external diameter and thickness. The cast shell is made of a high hardness and wear resistant material as described above and may be made by using either standard static or centrifugal casting methods.

Figure 2:
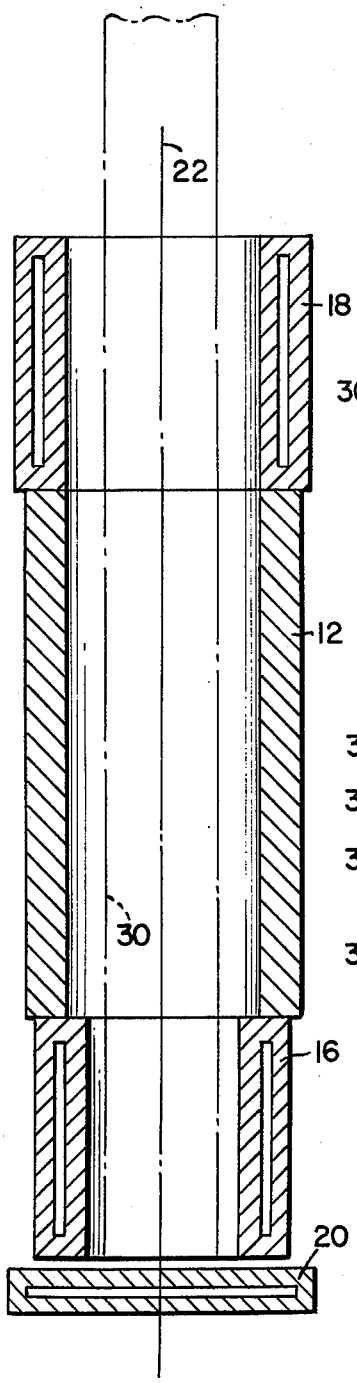
FIG. 2 is a diagrammatic illustration of the mold assembly used in carrying out the method in accordance with the invention.

The next step in the method in accordance with the invention is to set up the mold assembly as is shown in FIG. 2. The mold assembly comprises a bottom mold section 16 for forming the bottom neck portion of the roll, the shell portion 12, which is positioned on top of the mold section 16, and a top mold section 18, which is positioned on top of the shell portion 12 and serves to form the top neck portion of the roll. Each of the mold sections 16 and 18 is made of a water-cooled, copper, hollow cylindrical mold or other suitable construction. At the bottom of the mold section 16 a water-cooled copper base plate 20 is secured in position to close the bottom end of the mold section 16 in accordance with conventional casting techniques. The top mold section 18 is fitted in place on top of the upper end of the shell portion 12 as is shown in FIG. 2. The longitudinal axes of the shell portion 12 and the mold sections 16 and 18 are aligned along an axis 22 and extend vertically as is shown in FIG. 2. It is noted that the shell portion 12 forms the center of the three section mold assembly shown in FIG. 2.

The next step is to fill the mold assembly by the use of an electro-slag melting process to melt an electrode which has been pre-cast to the size to fill the three sections of the mold assembly. The electrode is made of the required chemical composition such that on remelting and subsequent resolidification it produces a center core and neck portion of the properties described above.

Figure 3:
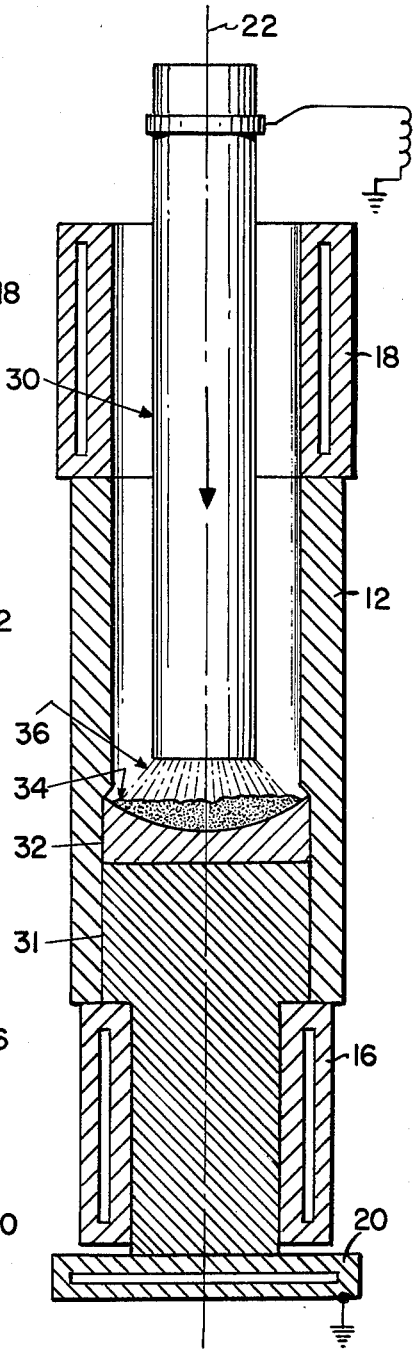
FIG. 3 is a diagrammatic illustration showing the method in accordance with the invention at a stage wherein the electrode is in place in the mold assembly and the melting process is in operation.

Various types of electro-slag melting processes are known and may be utilized to effect the melting of the electrode in accordance with the method of the invention. The preferred electro-slag process is illustrated in FIG. 3 and is the basic process in which molten metal drops from the electrode and descends through a molten slag to collect in a refined metal pool therebeneath. The slag protects the molten pool surface from oxidation.

In the electro-slag melting process shown in FIG. 3, a predetermined amount of melting stock material is placed on the bottom of the mold section 16. A powdered slag material is used to cover this small amount of melting stock. An electrode 30, which has been pre-cast as described above, is lowered into place in the mold assembly to a position as is illustrated in dashed lines in FIG. 2. Power is then applied from a suitable supply (such as the secondary of a transformer) to the top end of the electrode 30 to cause an arc to be struck with the melting stock material and the melting process begins. A ground connection is provided from the plate 20. The electrode 30 is a consumable one and melts to supply the molten metal pool as shown in FIG. 3. Referring to FIG. 3, the solidified metal is indicated at 31, the molten metal pool is indicated at 32, the slag is indicated at 34 and the arc stream is indicated at 36. As the electrode 30 is consumed, it is fed downwardly in the direction of the arrow shown in FIG. 6. As the electrode 30 is caused to melt, it progressively, in a continuous process, fills the mold section 16, the interior of the shell portion 12, and finally the top mold section 18. As the interior of shell portion 12 is filled with the melted electrode material, there is formed an intimate bonding between the melted electrode material and the internal wall of the shell 12.

The method in accordance with the invention produces a compound mold in a very economical manner. Moreover, the method can be controlled within very precise limits and the composition of the core and neck portion can also be controlled precisely. Furthermore, the bonding between the center core and the shell portion 12 can also be controlled closely.

I claim:

1. A method of making a compound roll to be used as a rolling mill roll, said compound roll having a shell portion of a first material of high hardness and wear resistance and a core portion forming the roll center core and neck sections of a second material, comprising the steps of pre-casting the shell portion in the form of a hollow cylinder having predetermined external and thickness dimensions, setting up a mold assembly with the shell portion on top of a mold section for forming a neck of the roll with the longitudinal axis of the shell portion and mold section extending vertically, positioning an electrode of an electro-slag melting unit within the interior of the shell portion and the neck mold section, said electrode being pre-formed out of a material having the chemical composition to produce said core portion of said second material on melting and resolidification, and effecting the melting of said electrode so as to fill the interior of said shell portion and the interior of said mold section.

2. The method of claim 1 wherein the melting of said electrode is caused by supplying electric current to said electrode so as to form an electric arc between the lower end thereof and a molten pool of metal therebeneath.

3. The method of claim 2 wherein said mold assembly is provided with a top neck mold section set on top of said shell portion.

4. The method of claim 3 wherein said electrode is fed into the mold assembly as it is melted.

5. The method of claim 4 wherein said electrode is melted in a continuous process to progressively fill the bottom mold section, the interior of said shell portion, and the top mold section.

6. The method of claim 1 wherein said second material is one having a low alloy content and a relatively low hardness.

7. The method of claim 6 wherein the melting of said electrode is caused by supplying electric current to said electrode so as to form an electric arc between the lower end thereof and a molten pool of metal therebeneath.

8. The method of claim 7 wherein said mold assembly is provided with a top neck mold section set on top of said shell portion.

9. The method of claim 8 wherein said electrode is melted in a continuous process to progressively fill the bottom mold section, the interior of said shell portion, and the top mold section.

10. Apparatus for the making of a compound roll to be used as a rolling mill roll, said compound roll having a shell portion of a material of high hardness and wear resistance and a center core and neck portion of a second material comprising a mold assembly including a pre-cast shell portion in the form of a hollow cylinder having predetermined external and thickness dimensions, a bottom hollow cylindrical mold section for forming one neck of the roll, a top hollow cylindrical mold section for forming the other neck of the roll, said mold assembly being set up with said shell portion located between said mold sections with the longitudinal axes of said shell portion and said mold sections being aligned and extending vertically and an electroslag melting unit including an electrode pre-formed out of a material having the chemical composition to produce said center core neck portion on melting and resolidification, and means for effecting the melting of said electrode so as to fill progressively the interior of said bottom mold section, said shell portion, and the interior of said top mold section.

* * * * *